United States Patent [19]

Butler

[11] Patent Number: 4,488,919

[45] Date of Patent: Dec. 18, 1984

[54] METHOD FOR MAKING SIMULATED BEVELED AND LEADED GLASS WINDOW STRUCTURE

[75] Inventor: Donald R. Butler, Newport Beach, Calif.

[73] Assignee: Stained Glass Overlay, Inc., Mission Viejo, Calif.

[21] Appl. No.: 395,734

[22] Filed: Jul. 6, 1982

Related U.S. Application Data

[60] Continuation-in-part of Ser. No. 386,987, Jun. 10, 1982, Pat. No. 4,438,165, which is a continuation-in-part of Ser. No. 158,919, Jun. 12, 1980, Pat. No. 4,335,170, which is a division of Ser. No. 962,123, Nov. 20, 1978, abandoned.

[51] Int. Cl.[3] ..... B44F 1/06

[52] U.S. Cl. ..... 156/153; 52/311; 156/63; 156/257; 428/38

[58] Field of Search ..... 156/63, 254, 153, 257; 428/38, 60, 912.2; 52/308, 311

[56] References Cited

U.S. PATENT DOCUMENTS

| | | | |
|---|---|---|---|
| 3,183,140 | 5/1965 | Gibson, Jr. | 428/38 |
| 3,420,728 | 1/1969 | Haverstock | 156/63 X |
| 3,713,958 | 1/1973 | McCracken | 156/63 X |
| 4,068,441 | 1/1978 | Shaffer | 52/308 |
| 4,312,688 | 1/1982 | Brodis et al. | 428/38 X |
| 4,335,170 | 6/1982 | Butler | 156/63 X |
| 4,438,165 | 3/1984 | Butler | 428/38 |

FOREIGN PATENT DOCUMENTS

| | | | |
|---|---|---|---|
| 1116470 | 1/1982 | Canada | 52/311 |

*Primary Examiner*—Henry F. Epstein
*Attorney, Agent, or Firm*—Robert E. Strauss

[57] ABSTRACT

Simulated beveled and leaded glass products which include flat-bottomed, beveled grooves formed in the front surface of a pane of glass or plastic, forming design segments of unrelieved thickness surrounded by beveled grooves, and a plurality of lead strips bonded to the flat bottom walls of the grooves, thus enclosing the design segments and simulating beveled and leaded glass.

7 Claims, 6 Drawing Figures

FIG 4
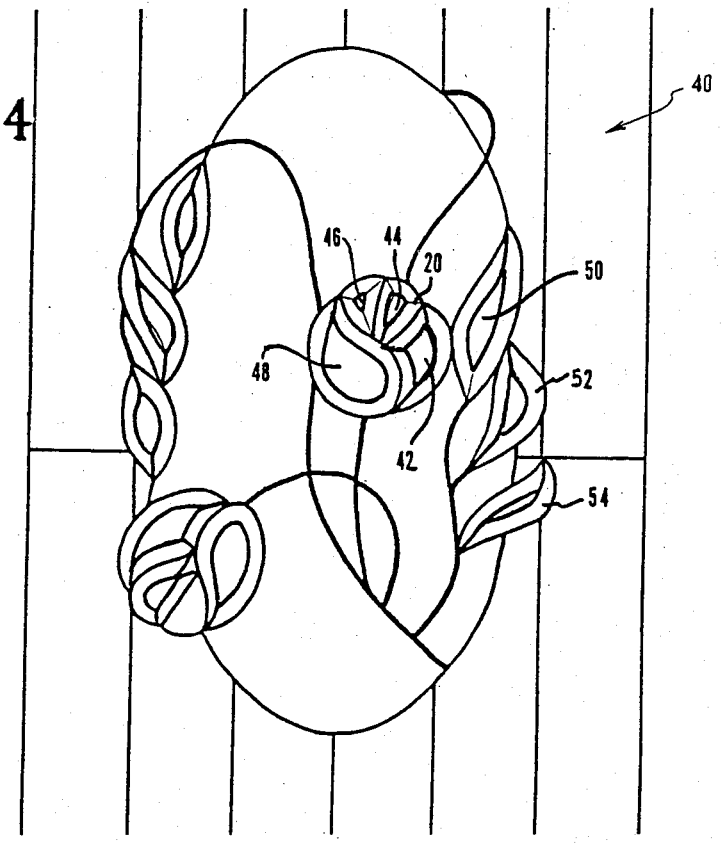
FIG 5
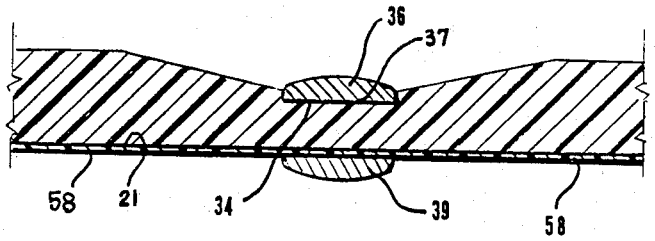
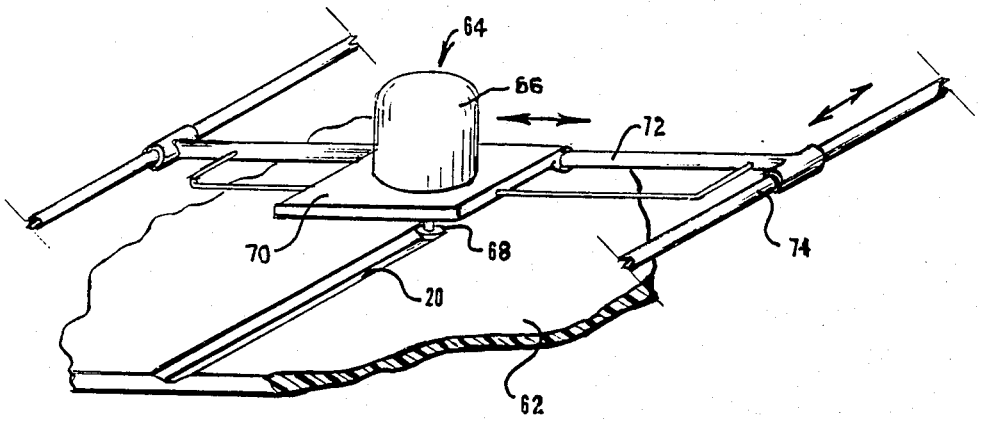
FIG 6

METHOD FOR MAKING SIMULATED BEVELED AND LEADED GLASS WINDOW STRUCTURE

REFERENCE TO RELATED APPLICATION

This application is a continuation in part of copending application, Ser. No. 386,987, filed June 10, 1982 now U.S. Pat. No. 4,438,165, which is a continuation in part of application Ser. No. 158,919, filed June 12, 1980, now U.S. Pat. No. 4,335,170, issued June 15, 1982 as a division of parent application Ser. No. 962,123, field Nov. 20, 1978 now abandoned.

BACKGROUND OF THE INVENTION

1. Technical Field

This invention relates generally to decorative panels and, more specifically, to decorative panels simulating the appearance of beveled and leaded glass.

2. Description of the Prior Art

Beveled glass has enjoyed a popularity for generations and its inherent beauty has been utilized in many architectural applications, particularly in turn of the century homes and offices where it was used primarily as panels, inset in doors and windows. Recent interest in classic antiquity of building has renewed interest in beveled glass for use in commercial and residential structures.

Beveled glass traditionally is formed by grinding beveled grooves in smooth surface panels of glass. This technique involves a time consuming and arduous process using expensive diamond grinding wheels and heads. Usually V-shaped beveled grooves are formed and the beveled glass is used without the application of lead came. When a leaded glass panel is formed, it is necessary to cut individual segments of glass, bevel their edges and then join such segments with grooved lead came. The extensive use of came, especially in a large glass pane, e.g., in a window embodying an intricate design, results in a loss of structural integrity since the assembly of cut segments have less strength than a pane of uncut glass and the lead came adds to the weight of the window and coincidentally makes the window pliable along each lead line. Thus, "authentic" beveled and leaded glass windows which are of moderate to large size must be externally supported, for example, by metallic bars, which detract from the beauty of the design. In addition, "authentic" beveled and leaded glass is unsuitable for curved surfaces or environments which are exposed to extreme or frequent vibrations.

In the construction of new buildings in particular, "authentic" beveled and leaded glass is generally unsuitable for many windows as building codes frequently specify single pane tempered or plate glass for entry ways and windows installed in bearing walls. Moreover, tempered glass cannot be scored and broken in the manner required by such traditional techniques and the segmented nature of the "authentic" beveled and leaded glass is, thus, clearly prohibited in most residential and commerical applications. Other applications such as skylights, shower doors, etc., also have not been attempted because of the inherent weakness of beveled glass. As a result of the above disadvantages, beveled and leaded glass is rarely used, despite its classic beauty and antiquity.

Recently, molded acrylic plastic panels with beveled grooves have appeared on the market under the Crystacrylic label. These panels, however, are not provided with lead strips and are not grooved adequately to accept lead strips in a manner that would closely simulate leaded glass.

Although paints, varnishes, colored gelatin, acetate, cellophane, and tissue paper with adhesive-backed lead strips or lead emulsions have been affixed to glass to simulate stained and leaded glass, no attempts have been made to simulate beveled and leaded glass. Additionally, most attempts to simulate stained and leaded glass have not resulted in the permanence and beauty of "authentic" stained and leaded glass while producing a structurally sound window suitable for use in large sizes, in curved windows, and in locations exposed to vibrations. In my prior patent, U.S. Pat. No. 4,335,170, I disclosed and claim a method for producing a simulated stained and leaded glass panel which achieves the foregoing results.

BRIEF STATEMENT OF THE INVENTION

Simulated beveled and leaded glass panels are prepared in accordance with the invention by forming beveled grooves of a particular shape in at least one side of a pane of plastic or glass, and then inserting and permanently affixing lead strips in the beveled grooves so formed. The beveled grooves are formed with sidewalls beveled at an angle from 10 degrees to about 70 degrees and with a flat bottom wall having a width corresponding to the width of the lead strips which are to be used. The invention uses lead strips having a width from 0.1 to about 0.6 inch which are coated with adhesive and applied to the flat bottom walls of the beveled grooves. The latter are formed in at least one surface of a clear glass or plastic pane to define design segments of a preselected pattern which are surrounded by the beveled grooves and lead stips. Additionally, lead strips may then be applied to the second side of the pane coinciding with the orginal lead strips, thereby completely simulating lead came.

Colored plastic film such as polyester film can be applied to the reverse side of the pane as disclosed in my parent applications to simulate stained glass, thus providing simulated beveled, stained and leaded glass. The polyester film which is applied with an adhesive bonding to the pane becomes permanently affixed to the pane and, coincidentally, becomes a bonding media which minimizes shattering should the pane be broken, and which insulates the pane and reduces its transmission of ultra-violet sun rays. The plastic film can also be silvered or metallic in appearance, or alternatively, a silvered coating can be applied to the reverse, ungrooved side of the pane to provide a beveled, leaded mirror.

BRIEF DESCRIPTION OF THE DRAWINGS

The invention may be more fully appreciated from the following detailed description of the preferred embodiment thereof taken in conjunction with the appended drawings wherein:

FIG. 4 is a plan view of a portion of a pane embodying a modification of the embodiment shown in FIG. 1;

FIG. 5 is a sectional view along line 5—5 of FIG. 4; and

FIG. 6 is a simplified illustration of a method for forming the beveled grooves used in the invention.

DETAILED DESCRIPTION OF A PREFERRED EMBODIMENT

Figure 1:
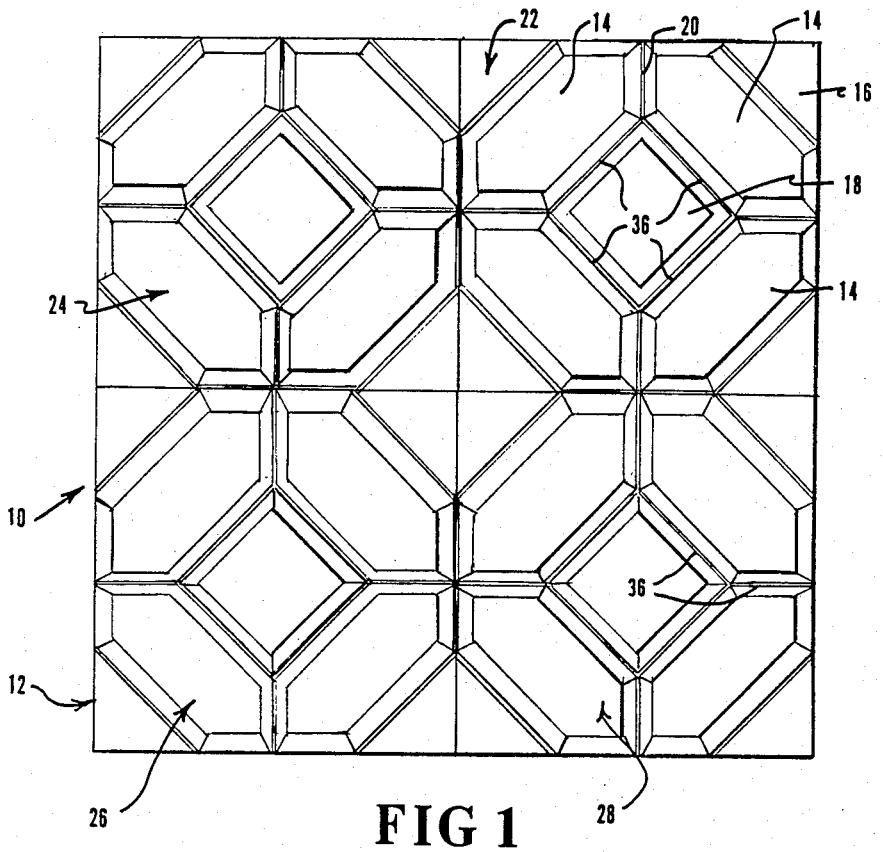
FIG. 1 is a plan view of a pane embodying this invention.
Figure 2:
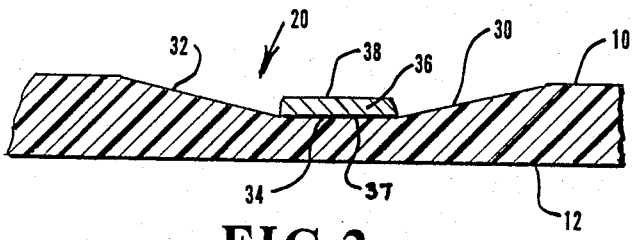
FIG. 2 is a sectional view taken along line 2—2 of FIG. 1.

Referring now to FIGS. 1 and 2, a glass or plastic pane may be seen to be divided into a plurality of closed segments 14, 16 and 18 by beveled grooves 20. The pane may be any smooth, transparent surface. Permissible materials of construction of the pane include double strength, safety plate and frosted glass. The preferred materials, however, are plastic such as polyacrylics, polycarbonates or mixtures of polycarbonates and acrylics such as Acrylic AD, a commercial designation for a mixture of acrylic and polycarbonate having high impact strength and resistance to yellowing. In addition, while a flat planar surface is shown, the pane may incorporate curved surfaces as found, for example, in vehicle windows and domed skylights. For illustrative purposes, each pane will be assumed to incorporate a front side 10 and a reverse side 12.

In a preferred embodiment, the pane is formed into repetitious patterns of design segments with each pattern 22, 24, 26 and 28 repeating the predetermined arrangement of design segments 14, 16, 18 and 22, all enclosed with the beveled grooves 20. This permits fabrication of a single pane which can used in its entirety or can be subdivided into smaller panes to fit varied size applications.

Referring now to FIG. 2, the beveled grooves 20 are formed with beveled sidewalls 30 and 32 having an angle from 10 to about 70 degrees with the vertical axis and with a flat bottomed wall 34 having a width from about 0.1 to about 0.6 inch, corresponding to the width of the lead strips which are used to simulate lead came. The beveled grooves are formed to a depth similar to the depth of bevels commonly found in beveled glass, e.g., from 1/16 to about $\frac{3}{8}$ inch. To some degree the depth of the bevel depends on the thickness of the sheet used for the pane and the depth can be from 25% to about 75%, preferably about 35 to 55% of the thickness of the pane.

The lead strips 36 are preferably extruded from commercially pure lead or, alternatively, extruded using a lead alloy containing approximately 2% antimony, which alloy has a comparatively slower rate of oxidation. The lead or lead alloy strips 36 may be of various widths depending upon the desired esthetic effect and are preferably approximately 0.022 inch thick with one flat side. The lead strips 36 can have a flat or rounded crown 38, preferably lead strips with flat crowns such as illustrated are used. The lead strips 36 also have a flat undersurface 37.

Figure 3:
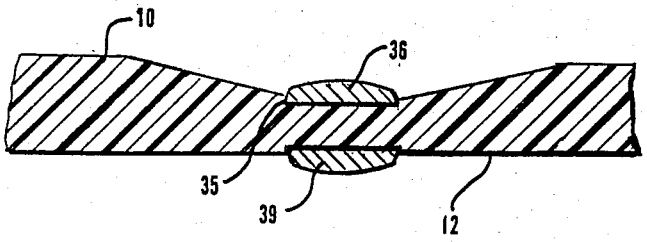
FIG. 3 is a sectional view simular to FIG. 2 showing an alternative embodiment.

Referring now to FIG. 3, there is illustrated a modification of the invention in which the flat bottom wall 35 of the beveled grooves is inset a slight distance, from 0.001 to about 0.01 inch, preferably from 0.002 to 0.005 inch, thus permitting the lead strip 36 to be slightly inset into the panel in a manner that simulates lead caming more authentically than the embodiment of FIG. 2. Also shown in FIG. 3 is an embodiment in which a second plurality of lead strips 39 are applied to the reverse side 12 of the pane.

For simulated beveled and leaded glass which are to be viewed from both the front side 10 and reverse side 12, it is preferred to apply a second plurality of lead strips 39 to the reverse side 12 of the pane as shown in FIG. 3. The second plurality of lead strips 39 may be spatially located to coincide with the first lead strips 36 and these strips overlie the first lead strips 36, thus simulating authentic lead caming. The use of a second plurality of lead strips 39 is also particularly desirable when the adhesive used to secure the first plurality of lead strips 36 is black.

In the preferred embodiment, the pane is prepared by machining the beveled grooves in its front surface as described in greater detail hereinafter. Alternatively, any or all of the design segments can also simulate beveled glass by application of transparent coatings having a substantial thickness, e.g., a glass, polycarbonate or poly(methylmethacrylate) sheet up to about $\frac{1}{4}$ inch thick and having beveled edges can be laminated to a base pane. A jeweled glass appearance can also be simulated in one or more of the design segments by applying one or more flat-sided shapes or transparent material such as glass, polycarbonate or poly(methylacrylate). The exterior surface of these shapes can be faceted, or have a smooth curvature. These shapes can be secured with a pressure sensitive adhesive.

Referring now to FIG. 4, there is shown a portion 40 of a beveled and leaded panel. The panel has an artistic rose pattern defined by beveled grooves 20 which are of the same configuration as shown in FIG. 1. The artistic pattern is formed in the panel in the same manner as described with reference to FIG. 1 wherein beveled grooves 20 are formed in its front surface, subdividing the panel into a plurality of design segments such as 42, 44, 48, 50, 52 and 54 of unrelieved thickness. These beveled grooves have flat bottomed walls and each receives a lead strip 36 coextensive its length, all as described with reference to FIG. 1. Each segment of the design may be variously colored by the addition of a painted or tinted coating 58 of plastic film applied to the reverse side 12 of the pane with the edges of the coatings 58 coinciding with the lead strips 36 defining the segments. The resultant color of the pattern provides green color to design segments 50, 52 and 54, depicting leaves, and pink to red colors to design segments 42, 44, 46 and 48, depicting a rose.

The coating 58 is a film or sheet material. While colored polyester film is preferred, other sheet materials can be used for special effects, e.g., metal films, such as copper or brass. The preferred coating 58 is a flexible, transparent or translucent plastic such as vinyl or polyester resins, most preferably formed of a polyester sheet approximately one mil or thicker sold commercially under the trademark MYLAR. Interposed between the undersurface 12 of the pane and the coating 58 is an adhesive which greatly adds to the permanence of the simulated beveled and leaded glass window and, in addition, imparts shatterproof characteristics to the pane.

In another embodiment, the pane can be a mirror, and the coating applied to the reverse side can be a mirror coating such as a silver coating as commonly applied to the back of glass panes in mirror manufacture, or can be a metallic or silvered plastic coating such as a metallic Mylar coating. This will provide a beveled and leaded mirror. The entire reverse side can be coated with a mirror surface, or if desired, any of the design segments of the pane can be provided with a mirror coating on its reverse side to simulate a leaded and beveled pane formed of a plurality of mirrors and beveled clear or stained glass segments.

As shown in FIG. 5, a second plurality of lead strips 39 may be applied to the reverse side 12 of the pane coincidentally with the first plurality of lead strips 36. As mentioned in connection with FIG. 3, this embodiment would commonly be preferred where the pane is routinely viewed from both the front side 10 and reverse side 12. For simulated stained, beveled and leaded glass which is to be viewed from both the front side 10 and reverse side 12, it is preferred to apply a second plurality of lead strips 39 to the reverse side 12 of the pane as shown in FIG. 5. The second plurality of lead strips 39 may be spatially located to coincide with the first lead strips 36 and these strips overlie the first lead strips 36 and conceal the edges of the coatings 58. The use of a second plurality of lead strips 39 is also particularly desirable when the adhesive used to secure the first plurality of lead strips 36 is black.

The beveled grooves are formed in the pane, preferably by machining. In this method, a high speed rotary grinding wheel or cutting head is moved across the panel along predetermined paths to form the desired pattern. In the preferred method, a pane of plastic is cut with such high speed cutting heads. FIG. 6 schematically illustrates this method wherein a pane 62 is placed on a computer controlled grinding fixture 64. These fixtures are commercially available with computer tape controls. Briefly, such fixtures provide for x-y axis movement of a carriage mounted grinder or router 66 having a cutting head 68. The carriage 70 is slidably carried on arms 72 which are moveably supported by cross-bars 74. The entire movement is automated and very complex patterns can be precisely cut in the pane.

The cutting head has a profile which will cut the desired flat bottomed beveled grooves 20 as it is moved across the front surface 10 of the pane. After the beveled grooves have been formed in the pane, they are polished to optical quality smoothness.

In an alternative method, the pane can be molded by injecting molding techniques wherein the resin such as polycarbonate, polyacrylate, or a mixture thereof, is melted and injected under high pressure, typically from 1500 to about 6000 psig., into an injection mold which is polished sufficiently to produce panes with optical quality smoothness.

In both methods, flat bottomed beveled grooves are formed in the front surface 10 of the pane. The pane is then treated to impart surface hardness and scratch resistance using conventional treatments. The commercially available surface treatments are a Vaporized Quartz treatment available from Hoya Industries, Los Angles, and a Diatomized Coating available from Berg Industries, Burbank, Calif.

The lead strips are then applied to the flat bottomed walls of beveled grooves 20. An appropriate adhesive is applied to the flat undersurface 37 of the first lead strips 36. The adhesive is preferably either clear, silver-gray, or black depending upon the esthetic effect desired. The lead may then be stretched to remove any kinks and undesired bends and then laid upon the front side 10 of the pane, covering the flat bottomed walls of the beveled grooves. A wooden tool, not shown, having a concave contour similar to the convex exposed side of the lead strips 36 is preferably utilized to urge the lead strips 36 firmly into the flat bottomed walls of the beveled grooves in the pane thus removing all entrapped air pockets and sealing the edges of the strips 36 securely against the flat bottomed walls. Excess adhesive 21 may be removed by wiping with solvent, which can also remove any oxidation from the lead strips 36.

The next step involves applying the polyester coating 58 to the opposite side 12 of the pane when it is desired to simulate the appearance of colored glass. A sheet of polyester coating 58 must be chosen which equals or exceeds all the dimensions of the design section to be colored. Polyester films which are coated with waterproof adhesives are commercially available, or alternatively, the waterproof adhesive can be brushed, sprayed or rolled onto one side of the coating 58. Following the application of adhesive 21, a lubricant such as a soap solution must then be brushed, sprayed or rolled onto the same side of the polyester coating 58. The soap solution, not shown in the drawing, neutralizes the adhesive and allows the coating 58 to be positioned upon the reverse side 12 of the pane where it may be slid into position opposite the appropriate design segment. The coating 58 can be trimmed with a scissors or razor blade to the size and shape of its respective design segment so that it can be moved into position, matching the edges of the coating 58 with the lead strips 36 on the front surface 10 which delineate its respective design segment. The soap solution is then removed by pressing the coating 58 firmly against the reverse side 12 of the pane with a squeegee or similar tool. Thus, the adhesive permanently bonds the coating 58 to the pane.

From the discussion, it is clear that a polyester coating 58 tinted with impregnated pigments may be used to produce the desired color for each design segment. In addition, the polyester coating 58 may be painted, preferably by a silk screening process, prior to being applied to the pane as discussed previously. The use of silk screening allows a broad range of effects including the simulation of "opaque" or translucent beveled glass. This particular effect is enhanced by the use of "frosted" polyester. A third method of producing the desired color when utilizing the techniques of this invention involves the use of pigmented adhesive which again allows for a wide range of esthetic effects and colors.

If the polyester coating 58 used is of the painted type, as discussed above, a transparent polyester coating, not shown in the drawing, can be similarly applied to cover the first coatings 58 prior to attaching the second plurality of lead strips 39 and thus insure a permanent bond for the second lead strips 39. Using these techniques, there have been produced simulated beveled and leaded or stained and leaded panes for windows in vehicles where curvatures and vibrations make traditional beveled and leaded glass techniques inapplicable. Also, large beveled and leaded glass panes have been decorated where external supports are impractical or where building codes require a single pane as, for example, in a standard sliding glass door. It has been found that the time required to produce a simulated beveled and leaded glass window utilizing the techniques as described above is a fraction of the time which would be required were the more traditional glass beveling and caming methods to be used.

The invention can also be practiced more quickly than prior methods of beveling and caming glass, since individual, small pieces of clear or colored beveled glass need not be assembled into a large pane with lead came. The panels can be beveled into very complex patterns using either molding or machining techniques which provide mass manufacturing capability. The use of the plastic film coatings 58 is far superior to painting glass or plastic panels. The film can be colored in advance of its application and it can be applied much faster than a pane can be painted, since its application need not be interrupted to permit paint coatings to dry, and there is no need to mask off areas of the glass before applying coatings 58. The pressure sensitive adhesive also has an excellent adhesion and provides a permanent bonding of the coatings 58, where its peel strength exceeds its tear strength. The coating, particularly the polyester coating provides greater adhesion for paints than does a glass surface and the stability of the coating increases with weathering and age, far exceeding the durability of painted glass.

It is understood that the embodiment described above is merely an example of the application of the principles of this invention. Additional embodiments may be devised by those skilled in the art without departing from the spirit or scope of the invention.

I claim:

1. The method of preparing a simulated beveled and leaded glass window structure comprising:

a. forming a plurality of beveled grooves having flat beveled sidewalls with sharp edges and optical quality smoothness along the front face of a plate of substantially clear or translucent glass or plastic having a smooth front side and a smooth reverse side to subdivide said plate into design segments of unrelieved pane thickness surrounded by beveled grooves, and providing each groove with a sidewall angle from 10 to about 70 degrees and with a flat bottom wall having a width from 0.1 to about 0.6 inch; and b. inserting a plurality of lead strips having a width about equal to the width of said flat bottom walls and flat undersurfaces into each of said grooves and bonding the flat undersurfaces of said lead strips to said flat bottom walls of said grooves, thereby enclosing said design segments with said lead strips.

2. The method of claim 1 wherein said step of forming said beveled grooves comprises machining the front surface of a smooth surfaced pane of plastic and polishing of the machined grooves to optical quality smoothness.

3. The method of claim 2 wherein said machining is performed by cutting the smooth front surface of said pane of plastic.

4. The method of claim 2 wherein said flat bottom walls are formed with perpendicular walls at a depth from 0.001 to about 0.01 inch to provide a recessed mounting for said lead strips.

5. The method of claim 4 further including the steps of affixing a second plurality of lead strips with an adhesive to the reverse side of the pane in coincidental alignment with the first plurality of lead strips adhered to the front side of the pane, thereby simulating lead came.

6. The method of claim 5 further including the steps of affixing a plurality of sheet segments of plastic film coated with adhesive and cemented therewith to the reverse side of the pane to coincide with said design segments on the front side of said pane and affixing said second plurality of lead strips over the perimeter edges of said sheet segments of plastic film.

7. The method of claim 6 further including the steps of incorporating pigments to impart color to at least one of said sheet segments of plastic film, thereby simulating beveled and stained glass.

* * * * *